US011352099B2

(12) United States Patent
Harrod

(10) Patent No.: US 11,352,099 B2
(45) Date of Patent: Jun. 7, 2022

(54) TENSION DEVICE

(71) Applicant: Bruce Harrod, Gaines, MI (US)

(72) Inventor: Bruce Harrod, Gaines, MI (US)

( * ) Notice: Subject to any disclaimer, the term of this patent is extended or adjusted under 35 U.S.C. 154(b) by 99 days.

(21) Appl. No.: 16/789,470

(22) Filed: Feb. 13, 2020

(65) Prior Publication Data

US 2020/0255098 A1 Aug. 13, 2020

Related U.S. Application Data

(60) Provisional application No. 62/804,890, filed on Feb. 13, 2019.

(51) Int. Cl.
*B63B 21/20* (2006.01)
*B63B 21/00* (2006.01)

(52) U.S. Cl.
CPC ..... *B63B 21/20* (2013.01); *B63B 2021/003* (2013.01); *B63B 2021/005* (2013.01); *B63B 2021/203* (2013.01)

(58) Field of Classification Search
CPC ..... B63B 2021/003; B63B 2021/005; B63B 21/20; B63B 2021/203; B63B 32/73; B63B 34/60; A63B 21/0552; A63B 21/0555; A63B 21/0557
USPC ..... 114/230.2–230.3; 482/121, 126; 24/300, 24/301
See application file for complete search history.

(56) References Cited

U.S. PATENT DOCUMENTS 5,205,803 A * 4/1993 Zemitis ..... A63B 21/0552 482/121
5,694,879 A * 12/1997 Taylor ..... B63B 21/04 114/230.26
5,832,861 A * 11/1998 Taylor ..... B63B 21/04 114/230.26
6,202,263 B1 * 3/2001 Harker ..... B62J 7/08 114/230.2
8,495,964 B1 * 7/2013 Ronald ..... D04C 1/02 114/230.2
10,144,489 B2 * 12/2018 Harrod ..... B63B 21/502
10,384,094 B1 * 8/2019 Newman ..... A63B 71/0054

* cited by examiner

*Primary Examiner* — Ajay Vasudeva
(74) *Attorney, Agent, or Firm* — Harness, Dickey & Pierce, P.L.C.; Stephen T. Olson

(57) ABSTRACT

A tension device for securing a floating structure includes an elastic member, first and second end members, and an inelastic member. The elastic member is stretchable under tension from an unstretched length to a stretched length. The first and second end members are carried at first and second ends of the elastic member, respectively. The inelastic member is secured to the first and second end member and limits the stretched length of the elastic member. First and second restrictive apertures are limited in diameter by first and second sewn portions of the inelastic member, respectively. The first and second restrictive apertures prevent separation between the inelastic member and the first and second ends of the elastic member, when the tension device is loaded in tension.

13 Claims, 3 Drawing Sheets

TENSION DEVICE

CROSS-REFERENCE TO RELATED APPLICATION

This application claims the benefit of U.S. Provisional Patent Application No. 62/804,890 filed 13 Feb. 2019, which application is herein expressly incorporated by reference.

FIELD

The present teachings generally relate to a tension device. More particularly, the present teachings relate to a tension device for securing a floating structure, including but not limited to a boat.

BACKGROUND

This section provides background information related to the present disclosure which is not necessarily prior art.

Boats and other floating structures are commonly secured in the water with simple lines or ropes. For example, a boat may be secured to an anchor, dock or other fixed structure. Under certain conditions, such securement with simple lines or ropes may fail or cause damage. In this regard, wind and wave action may repetitively introduce slack and tension. This repeated cycle of slack and tension may cause an anchor to ultimately lose purchase.

To a more limited extent, it is known use elastic lines for securing a boat. While known elastic lines may have proven to be acceptable for certain applications, they are all associated with limitations. Accordingly, a need in the art remains for improvement.

SUMMARY

In accordance with one specific aspect, the present teachings provide a tension device for securing a floating structure. The tension device includes an elastic member, first and second end members, and an inelastic member. The elastic member is stretchable under tension from an unstretched length to a stretched length. The first and second end members are carried at first and second ends of the elastic member, respectively. The inelastic member is secured to the first and second end member and limits the stretched length of the elastic member.

In accordance with another specific aspect, the present teachings provide a method of securing a floating structure. The method includes connecting a first end of a tension device having an elastic member and an inelastic member to a fixed structure and a second end of the tension device to the floating structure. The method further includes limiting elongation of the elastic member with the inelastic member.

In accordance with another specific aspect, the present teachings provide a tension device for securing a floating structure. The tension device includes an elastic member, first and second end members and an inelastic member. The elastic member is stretchable under tension from an unstretched length to a stretched length. The inelastic member is tubular and includes first and second enlarged ends. The first and second end members are carried at first and second ends of the elastic member, respectively. Both of the first and second end members includes first and second material webbings extending in a direction perpendicular to the inelastic member and sewn to one another to define an opening through the elastic member passes the opening having a width smaller than the first and enlarged ends such that the first and second enlarged ends cannot be pulled through the respective opening. The first and second material webbings further define first and second ears on opposite sides of the respective opening. The first and second end members further include a loop of material webbing sewn to the first and second ears of the respective end members. The inelastic member limits the stretched length of the elastic member. The inelastic member is a sleeve surrounding the elastic member. The sleeve is sewn to the first and second end members. The loop of material webbing of both of the first and second end members is twisted between the respective first and second ears to convert a pulling force on the respective end member to a torque/construction force.

DRAWINGS

The drawings described herein are for illustrative purposes only of selected embodiments and not all possible implementations, and are not intended to limit the scope of the present disclosure.

DETAILED DESCRIPTION

Figure 1A:
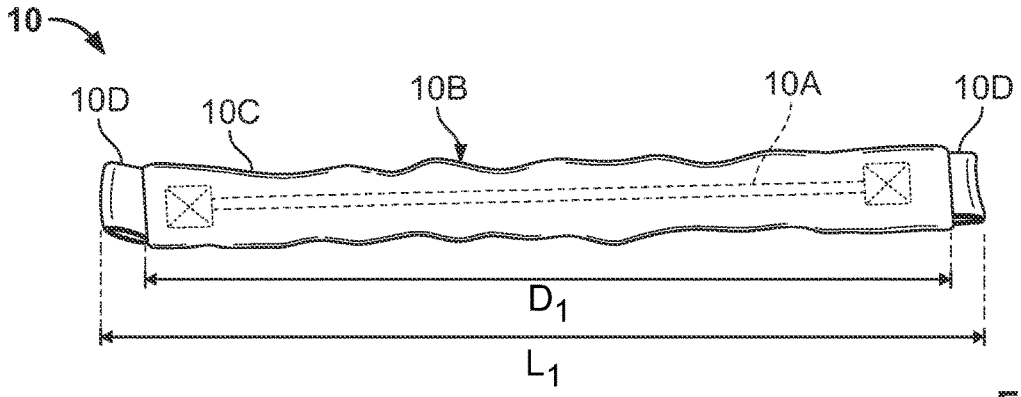
FIG. 1A illustrates a tension device in accordance with the present teachings, the tension device shown unstretched.

Example embodiments will now be described more fully with reference to the accompanying drawings.

With general reference to FIGS. 1A-1D and 2-3, a tension device in accordance with the present teachings is shown and generally identified at reference character 10. The tension device 10 is generally illustrated to include an elastic member 10A and in the particularly embodiment illustrated further generally includes an inelastic member 10B. The present teachings, however can be used without an inelastic member 10B for certain applications within the scope of the present teachings.

The elastic member 10A has a length between a first end and a second end. The length is an elastically variable length under tension. In the embodiment illustrated, the elastic member 10A is tubular and may be unitarily constructed of latex rubber. The elastic member 10A may be elongated under tension from a first length without any tension to a longer length that is greater than 200% of the first length. Preferably, the length of the elastic member 10A may be elastically elongated at least 300%. In one particular application, the elastic member may be elastically elongated at least approximately 400%. The strength capabilities of the tubular, elastic member 10A are significantly improved as compared to conventional, solid elastic lines.

The elastic member 10A may be formed by extruded molding and may include enlarged portions proximate the first and second ends 12 and 14. In one particular application, the elastic member 10A may have an outer diameter of approximately ⅝" and an inner diameter of ¼" over the central portion between the enlarged ends 12 and 14 (i.e., along most of the length) and the enlarged portions 12 and 14 may have a maximum diameter of approximately ⅞". In another particular application, the central portion may have a dimeter of 11/16", an inner diameter of 3/16" and a maximum diameter of the enlarged ends 12 and 14 of 15/16". The outer diameter of the central portion may be between ⅝" and 11/16". In the embodiment illustrated, the enlarged portions 12 and 14 defined by an insert 15 disposed within the hollow elastic member 10. In the embodiment illustrated, the elastic member 10A may be latex rubber.

The inelastic member 10B is illustrated to include an outer covering or tubular sleeve 10C surrounding the length of the elastic member 10A. The inelastic member 10B may further include end members 10D. The sleeve 10C may be connected to the elastic member 10A through the end members 10D. The end members 10D may be constructed of a inelastic polypropylene webbing. The sleeve 10C of the inelastic member 10B may be similarly constructed of an inelastic polypropylene webbing.

In the embodiment illustrated, the end members 10D may include first and second overlapping webbings 20 of inelastic material. The webbings 20 may be sewn or otherwise secured to one another on opposite sides of the elastic member 10A so as to define a sleeve or opening 22 through which the central portion of the inelastic member passes. The joined portions of the webbings 20 define ears 24.

As illustrated, specific sewing/stitching is created across the doubled-up segment of the flat webbing material to produce the sleeve or opening 22 for inserting the elastic member 10A into and through. The sleeve defines an opening with a width that is greater than the diameter of the central portion of the elastic member 10A but smaller than the diameter of the elongated ends 12 and 14. After the ends of the elastic member 10A pass through the opening 22 in the respective end member 10D, a bulbous insert 15 is inserted into each end of the elastic tubing 10A to create the enlarged ends or portions 12 and 14, thereby behind the sleeve, preventing the elastic tubing 10A from being pulled back through the opening 22. The webbing may be comprised of polypropylene, nylon, polyester, UHMWPE, other thermoplastic material or other suitable material. In the embodiment illustrated, the webbing material is an inelastic webbing material.

With respect to the stitching, two linear seams are made parallel to each other, centrally placed and transversely oriented, upon a doubled-up segment of flat webbing or other fabric material. The distance which separates these two parallel seams may be referred to as a "perimeter seam spread" and dictates the size of the openings 22 in the sleeve (manufacturing calculations are mathematically expressed as $2\pi r(1.025)/2$=Perimeter Seam Spread with r value being radius of elastic tubing being used. The 1.025 multiplier provides an assembly tolerance of 2.5% for ease of manufacturing). The length of the doubled up material segment may extend outwardly beyond these linear seams by at least 0.5 inch on each side to define ears and provide for attachment of a loop of flat webbing material or a deflection loop 26. Once the two linear perimeter seams are in place, the flat webbing 26 may be looped and attached (sewn) to each extension beyond the perimeter seams of the first sewn piece. This is done so in a perpendicular orientation from the sleeve segment. This perpendicular loop segment 26 can be any desired length or width to meet design or application objectives. The 90-degree directional change from the sleeve segment to the deflection loop segment puts a twist in the flat webbing of the deflection loop 26 and converts some of the pulling force to torque/constriction force within the sleeve segment. This constriction serves to offset webbing elongation within the sleeve due to heavy loading which would otherwise compromise the holding capabilities of a sleeve. As loading increases, constriction increases to compensate for stretching of the sleeve.

Sewing the ends of the deflection loop "off-center" to the pulling force also gives additional torque energy for the constriction sleeve. The angle of the loop down to the ears forces the ears to be drawn inward when there is a pulling force on the loop. This inward force will cause torque to be similarly CW or CCW at both ears based on the twist/angle of the flat webbing.

The elastic member 10 and the intermediate members 10D are passed through the inelastic sleeve 10B such that the intermediate members 10D extend beyond the inelastic sleeve 10B. The ends of the inelastic member are sewn or otherwise fixedly attached to the intermediate members 10D.

Figure 1B:
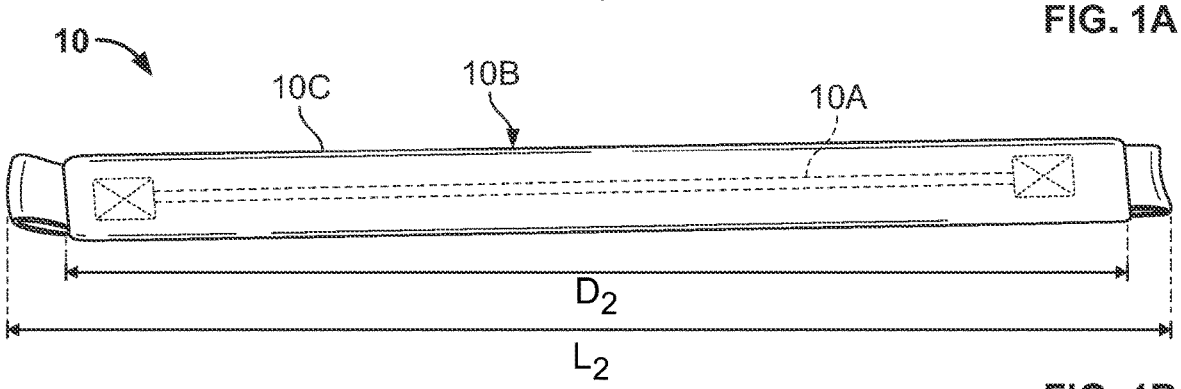
FIG. 1B is a further view of the tension device of FIG. 1A, the tension device shown fully elongated.
Figure 1C:
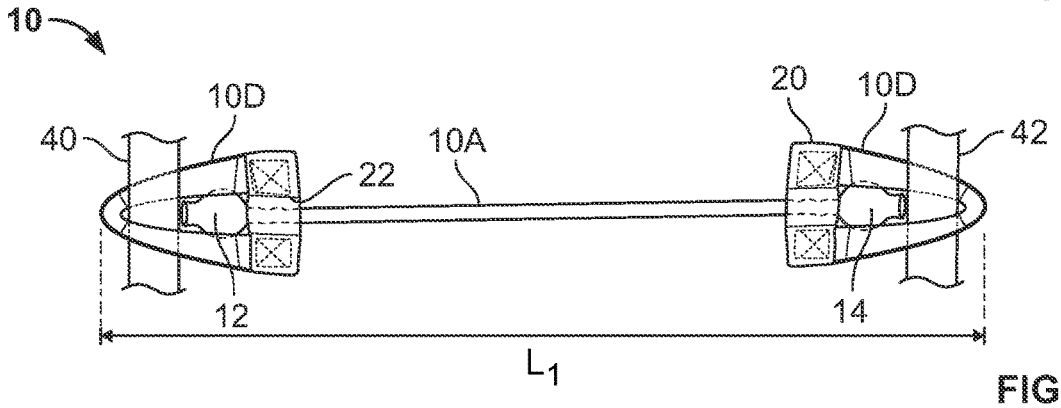
FIG. 1C is another view of the tension device of FIG. 1A, an outer inelastic covering of the tension device shown removed for purposes of illustration and the tension device shown unstretched between a fixed structure, such as part of a dock, and a floating structure, such as part of a boat.
Figure 1D:
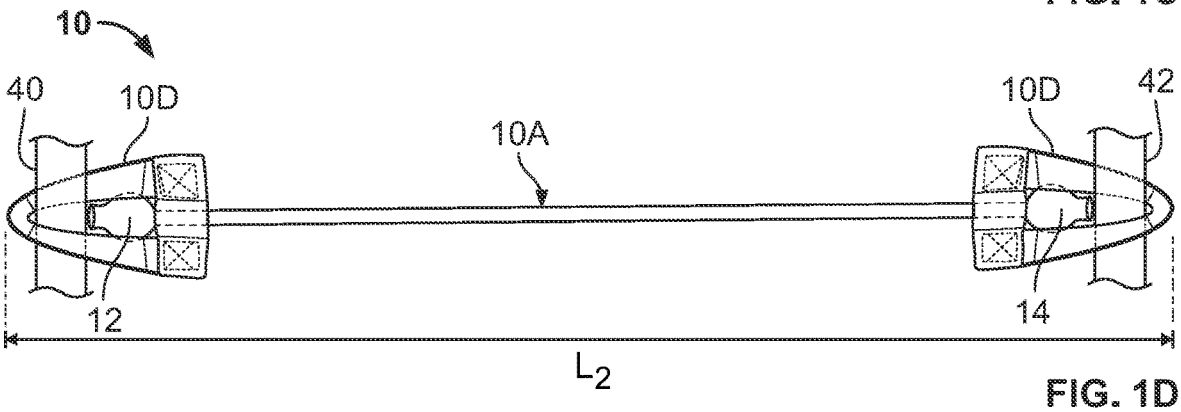
FIG. 1D is another view of the tension device shown with the inelastic covering removed, the tension device shown fully elongated between a fixed structure, such as part of a dock, and a floating structure, such as part of a boat.
Figure 2:
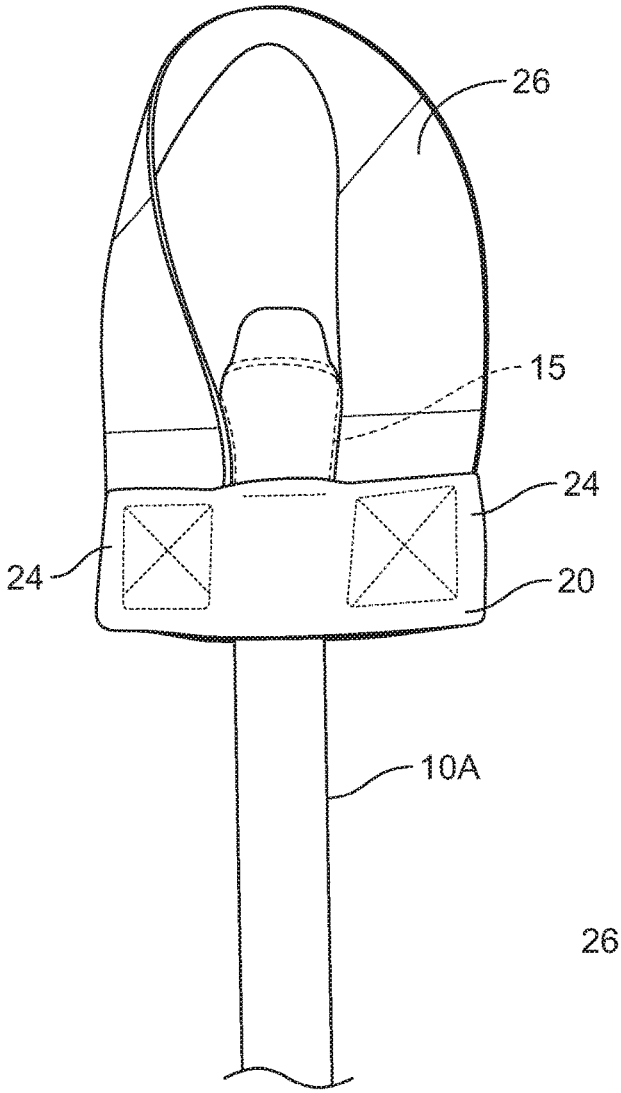
FIG. 2 is an enlarged view of one end of the tension device of FIGS. 1A-1D shown with the inelastic covering removed.
Figure 3:
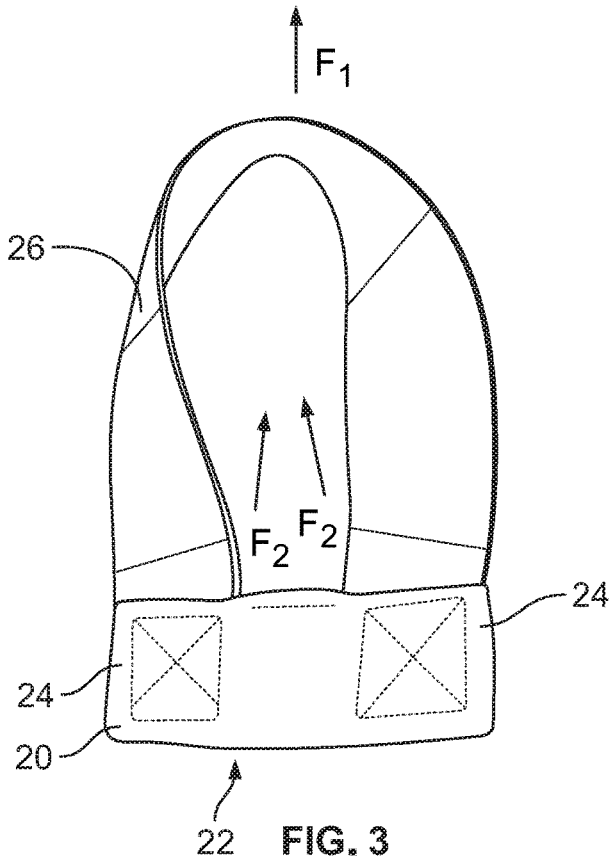
FIG. 3 is a schematic view illustrating the pulling forces associated with the tension device of FIG. 1A.

While inelastic, the sleeve 10B may be bunched along the length of the elastic member 10A (as shown in FIG. 1A) to shorten the distance between its two ends. When the elastic member 10A is put under tension, the distance between the two ends of the inelastic member 10B increases (as shown in FIG. 1B) as the inelastic member "unbunches". It must be noted that FIGS. 1A and 1C are not drawn to scale with FIGS. 1B and 1D.

In one particular application, the reduced diameter central portion of the elastic member 10A has a length of approximately 8.0". This length is an elastically variable length that may be stretched under tension to at least approximately 28.0". The maximum distance D2 between the ends of the inelastic sleeve 10B limit elongation of the elastic member 10A to a second length. In other applications, the elastic member 10A may have a shorter or a longer unstretched length. In this regard, the elastic member 10 may have an unstretched length of 6.0", 10.0", 18.0" or any other length within the scope of the present teachings. These other lengths may have the elongation characteristics described herein.

In the embodiment illustrated, the second length corresponds to an elongation of the elastic member 10A of approximately 24 inches (to a total of 32 inches) or 400%. When the tension member 10 is used to secure a boat, a spring constant of the elastic member 10 may be set based on expected wave size as well as the mass of the boat.

The tension device 10 of the present teachings is described above with regard to one particular application. It will be understood, however, that the scope of the present teachings is not limited to this particular application. In this regard, the tension device 10 may be used in alternative applications for securing a floating structure 42 relative to a fixed point. The fixed point may be ground, a dock, or other structure 40. For example, the tension device 10 of the present teachings may be used for docked marine vessels (keeping centered in slip), in-line buffers for weighted moorings and anchors, shock absorbers for ski and tubing two ropes, and tension hardware for floating docks and rafts. The tension devices 10 may also be under a ski ramp to maintain placement of the ski ramp. In other examples, the tension devices 10 may also be used in-line with an animal leash or tether for use with structure or transport trailer. The tension devices 10 may also be used in-line with a surfboard or paddleboard leash attaching to a user and a surf or paddle board. The tension devices 10 may also be used as part of a bungee device with hooks on both ends for securing cargo. The tension devices 10 may also be used in the construction of exercise equipment which uses tubular material for the elastic resistance properties. The tension devices 10 may also be used in-line as a tow snubber for pulling a rider on ski, wakeboard, or water tube behind a vessel. The tension devices 10 may also be used in-line for shock absorbing lanyard applications for tool drop impact and fall protection in the workplace or recreation. The tension devices 10 may also be used as a tether snubber for attaching riders to personal watercraft.

Figure 4:
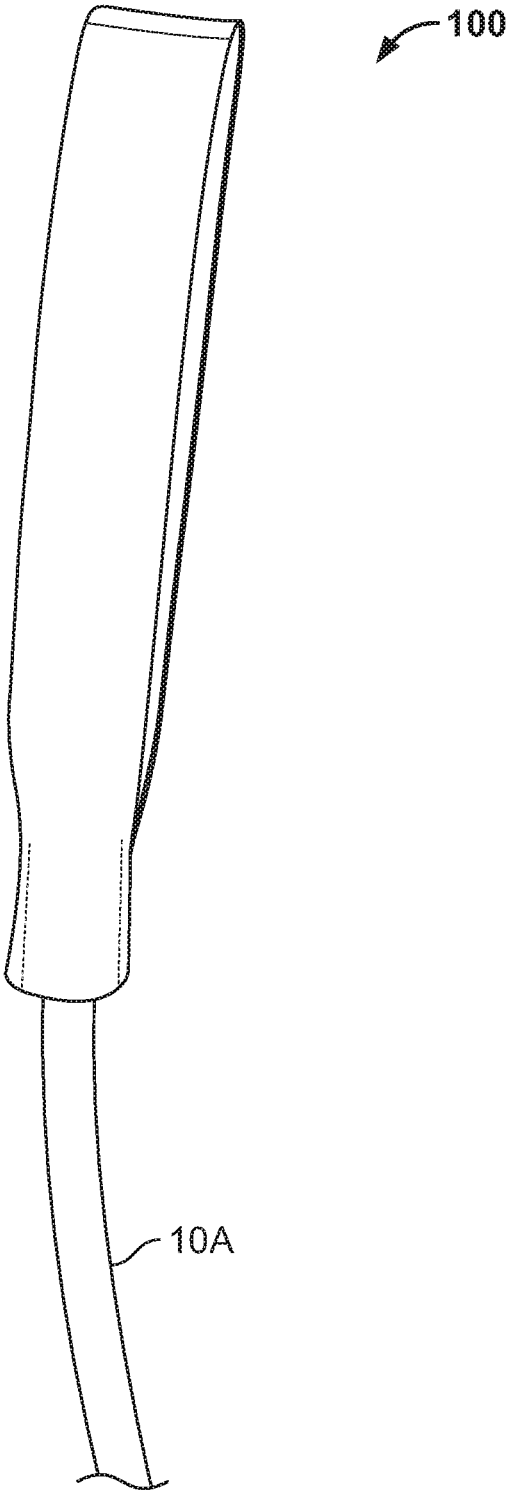
FIG. 4 is an enlarged end view similar to FIG. 2, illustrating another tension device in accordance with the present teachings.
Figure 5:
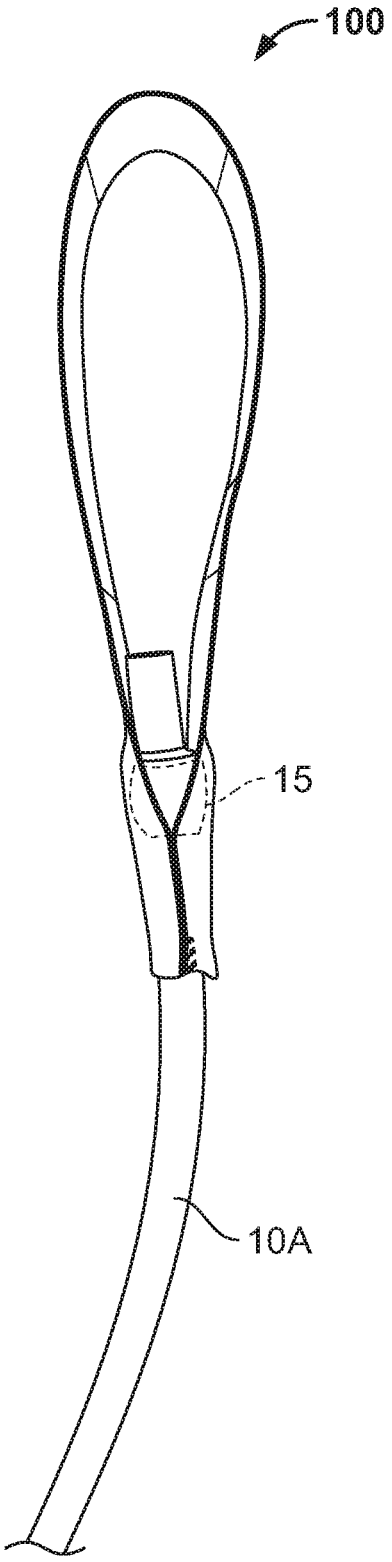
FIG. 5 is another enlarged end view of the tension device of FIG. 4.

Turning to FIGS. 4 and 5, another tension device in accordance with the present teachings is illustrated and generally identified at reference character 100. In this embodiment, specific sewing/stitching is created on the end of a looped or doubled-up segment of flat webbing material to produce a sleeve for inserting an elastic tubing member into and through. This webbing could be comprised of polypropylene, nylon, polyester, UHMWPE, or other thermoplastic material. With respect to this stitching, two linear seams are made parallel to each other, centrally placed and longitudinally oriented, upon a doubled-up segment of flat webbing or other fabric material. The distance which separates these two parallel seams is referred to as the "perimeter seam spread" and dictates the size of the created sleeve (Manufacturing calculations are mathematically expressed as $2\pi r(1.025)/2$=Perimeter Seam Spread with r value being radius of elastic tubing being used. The 1.025 multiplier provides an assembly tolerance of 2.5% for ease of manufacturing). Once the sleeve is complete, tubular elastic material is inserted through the sleeve and the bulbous insert 15 is placed inside the end of the tubing to prevent it from pulling back through the sleeve.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A tension device for securing a floating structure, the tension device comprising:

an elastic member stretchable under tension from an unstretched length to a stretched length;

first and second end members carried at first and second ends of the elastic member, respectively;

an inelastic member for limiting the stretched length of the elastic member, the inelastic member secured to the first and second end member; and first and second restrictive apertures limited in diameter by first and second sewn portions of the inelastic member, respectively, the first and second restrictive apertures for preventing separation between the inelastic member and the first and second ends of the elastic member, when the tension device is loaded in tension, wherein the elastic member includes a central portion with a first diameter along the length thereof and the first and second ends of the elastic member each having a second diameter, the second diameter greater than the first diameter wherein the first and second restrictive apertures each have a width, the width greater than the first diameter of the central portion of the elastic member and smaller than the second diameter of the first and second enlarged ends, wherein joined portions of first and second webbings of inelastic material extend perpendicular to the elastic member and both define ears on opposite sides of the elastic member, the first and second webbings of inelastic material sewn to create the restrictive apertures, and each webbing of inelastic material connected to a respective flat connection webbing defining a loop extending between the ears of the respective end member, and wherein each loop is twisted between the ears, such that both ends of each loop are attached at opposite ends of the first and second inelastic webbings, respectively, and therefore offset from a longitudinal pulling plane of the elastic member to convert a pulling force to a torque/constriction force.

2. The tension device for securing a floating structure of claim 1, wherein the elastic member is a tubular elastic member.

3. The tension device for securing a floating structure of claim 2, wherein the first and second enlarged ends are defined by first and second inserts, respectively, inserted into the tubular elastic member.

4. The tension device of claim 2, wherein the tubular elastic member is made of latex rubber.

5. The tension device of claim 2, wherein the tubular elastic member is elongatable under tension to a longer length that is greater than two hundred percent of an unstretched length.

6. The tension device for securing a floating structure of claim 1, wherein the inelastic member includes a sleeve surrounding the elastic member.

7. The tension device for securing a floating structure of claim 1, wherein each end member is constructed of a single webbing of inelastic material.

8. The tension device of claim 1, wherein the tubular elastic member is elongatable under tension to a length that is greater than a length of the inelastic member under tension.

9. The tension device of claim 1, wherein the first diameter of the central portion of the elastic member is equal to or between five-eighths inches and eleven-sixteenths inches.

10. A method of securing a floating structure with the tension device of claim 1, the method comprising:

connecting a first end of the tension device to a fixed structure and a second end of the tension device to the floating structure with loops of material webbing;

limiting elongation of the elastic member with the inelastic member; and maintaining a constant size of each loop connected to the floating structure and fixed structure throughout elongation of the elastic member.

11. A tension device for securing a floating structure, the tension device comprising:

an elastic member stretchable under tension from an unstretched length to a stretched length, the inelastic member being tubular and including first and second enlarged ends;

first and second end members carried at first and second enlarged ends of the elastic member, respectively, both of the first and second end members including first and second material webbings extending in a direction perpendicular to the inelastic member and the first and second webbings of each respective end member sewn back-to-back to define an opening through which the elastic member passes the opening having a width smaller than the first and second enlarged ends such that the first and second enlarged ends cannot be pulled through a respective opening, the first and second material webbings further defining first and second ears on opposite sides of the respective opening, the first and second end members further including a loop of material webbing sewn to the first and second ears of the respective end members; and an inelastic member for limiting the stretched length of the elastic member, the inelastic member being a sleeve surrounding the elastic member, the sleeve sewn to the first and second end members, wherein the loop of material webbing of both of the first and second end members is twisted between the respective first and second ears, where both ends of each loop are attached at opposite ends of the first and second material webbings, respectively, and therefore offset from a longitudinal pulling plane of the elastic member to convert a pulling force on the respective end member to a torque/construction force.

12. The tension device of claim 11, wherein the elastic member is a tubular elastic member made of latex rubber.

13. The tension device of claim 12, wherein the enlarged ends of the elastic member are defined by bulbous plugs inserted into each end of the tubular elastic member.

* * * * *